US007762521B2

(12) United States Patent
Brun et al.

(10) Patent No.: US 7,762,521 B2
(45) Date of Patent: Jul. 27, 2010

(54) SEMI-ACTIVE COMPRESSOR VALVE

(75) Inventors: Klaus Brun, Helotes, TX (US); Ryan S. Gernentz, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 549 days.

(21) Appl. No.: 11/752,700

(22) Filed: May 23, 2007

(65) Prior Publication Data

US 2007/0272178 A1 Nov. 29, 2007

Related U.S. Application Data

(60) Provisional application No. 60/747,991, filed on May 23, 2006.

(51) Int. Cl.
*F16K 31/00* (2006.01)

(52) U.S. Cl. ..... 251/64; 251/65; 251/129.04; 251/129.15

(58) Field of Classification Search ..... 251/64, 251/65, 129.01, 129.04, 129.15; 137/511, 137/514
See application file for complete search history.

(56) References Cited

U.S. PATENT DOCUMENTS

| | | | | |
|---|---|---|---|---|
| 4,936,423 | A | 6/1990 | Karnopp | 188/299 |
| 5,005,353 | A | 4/1991 | Acton et al. | |
| 5,024,302 | A | 6/1991 | Karnopp | 188/299 |
| 5,248,191 | A | 9/1993 | Kondo et al. | 303/117.1 |
| 5,354,185 | A | 10/1994 | Morinigo et al. | |
| 5,727,769 | A * | 3/1998 | Suzuki | 251/129.15 |
| 5,749,388 | A * | 5/1998 | Elliott et al. | 137/1 |
| 6,056,000 | A * | 5/2000 | Santacatterina et al. | 137/1 |
| 6,616,421 | B2 | 9/2003 | Mruk et al. | 417/350 |
| 6,883,775 | B2 | 4/2005 | Coney et al. | 251/48 |
| 6,976,500 | B2 | 12/2005 | Lorenz-Börnert | 137/106 |
| 2004/0263158 | A1 | 12/2004 | Biester et al. | 324/207.24 |
| 2007/0154325 | A1 | 7/2007 | Grant et al. | |

FOREIGN PATENT DOCUMENTS

JP 57 130115 8/1982

OTHER PUBLICATIONS

Keebler, "Cadillac Suspension is Smooth Stuff", Automotive News, 2 pages, 1992.
Staff, "Gasoline DI Spells Two Engines in One", Design News, 2 pages, 2000.
Ogando, "Drain Problems Solved; David Flinchbaugh's Invention Restores Normality to Patients Forced to Use Urinary Catheters", Design News, 3 pages, 2003.
Fohn, "Valve Will Help Gas Industry Save Maintenance Costs, Software Program Can Predict Corrosion in Alloys", 2007 R&D 100 Winners, pp. 4-5, 2007.
International Search Report for PCT/US2009/038837, (2009).

* cited by examiner

*Primary Examiner*—John K Fristoe, Jr.
(74) *Attorney, Agent, or Firm*—Chowdhury & Georgakis PC

(57) ABSTRACT

A method and system for fine-tuning the motion of suction or discharge valves associated with cylinders of a reciprocating gas compressor, such as the large compressors used for natural gas transmission. The valve's primary driving force is conventional, but the valve also uses an electromagnetic coil to sense position of the plate (or other plugging element) and to provide an opposing force prior to impact.

6 Claims, 2 Drawing Sheets

SEMI-ACTIVE COMPRESSOR VALVE

RELATED PATENT APPLICATION

This application claims the benefit of U.S. Provisional Application No. 60/747,991, filed May 23, 2006 and entitled "RECIPROCATING GAS COMPRESSOR HAVING SEMI-ACTIVE COMPRESSOR VALVES."

GOVERNMENT LICENSE RIGHTS

The U.S. Government has a paid-up license in this invention and the right in certain circumstances to require the patent owner to license others on reasonable terms as provided for by the terms of Contract No. DE-FC26-04NT-42269 for the United States Department of Energy.

TECHNICAL FIELD OF THE INVENTION

This invention relates to large gas compressors for transporting natural gas, and more particularly to a valve design for reciprocating gas compressors.

BACKGROUND OF THE INVENTION

Most natural gas consumed in the United States is not produced in the areas where it is most needed. To transport gas from increasingly remote production sites to consumers, pipeline companies operate and maintain hundreds of thousands of miles of natural gas transmission lines. This gas is then sold to local distribution companies, who deliver gas to consumers using a network of more than a million miles of local distribution lines. This vast underground transmission and distribution system is capable of moving many billions of cubic feet of gas each day. To provide force to move the gas, and to improve the economics of gas transportation, operators install large compressors at transport stations along the pipelines.

The single largest maintenance cost for a reciprocating compressor is compressor valves. Valve failures can primarily be attributed to high-cycle fatigue, sticking of the valve, accumulation of dirt and debris, improper lubrication and liquid slugs in the gas. Valves are designed for an optimal operation point; hence, valve operation is impaired when the operating conditions deviate significantly from the design point. In the traditional compressor valve design, an increase in valve life (reliability) directly relates to a decrease in valve efficiency. This relationship is due to an increase in valve lift (and flow-through area) being limited by the corresponding increase in the valve impact force. Above a certain impact velocity, valve plate failure is attributable to plastic deformation of the valve springs. These springs fail to provide adequate damping for the plate. The design of the valve springs is a major weakness in the valves currently in use. A lack of durability and low efficiency of the passive valve design demonstrates the need to control valve motion.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to a design for a suction or discharge valve for a reciprocating gas compressor. More specifically, it is directed to modifying a plate type valve so that it is "semi-active" in the sense that the valve plate starting motion (both opening and closing) is sensed and the motion of the valve plate is fine-tuned, using electromagnetic sensing and control means.

Figure 1:
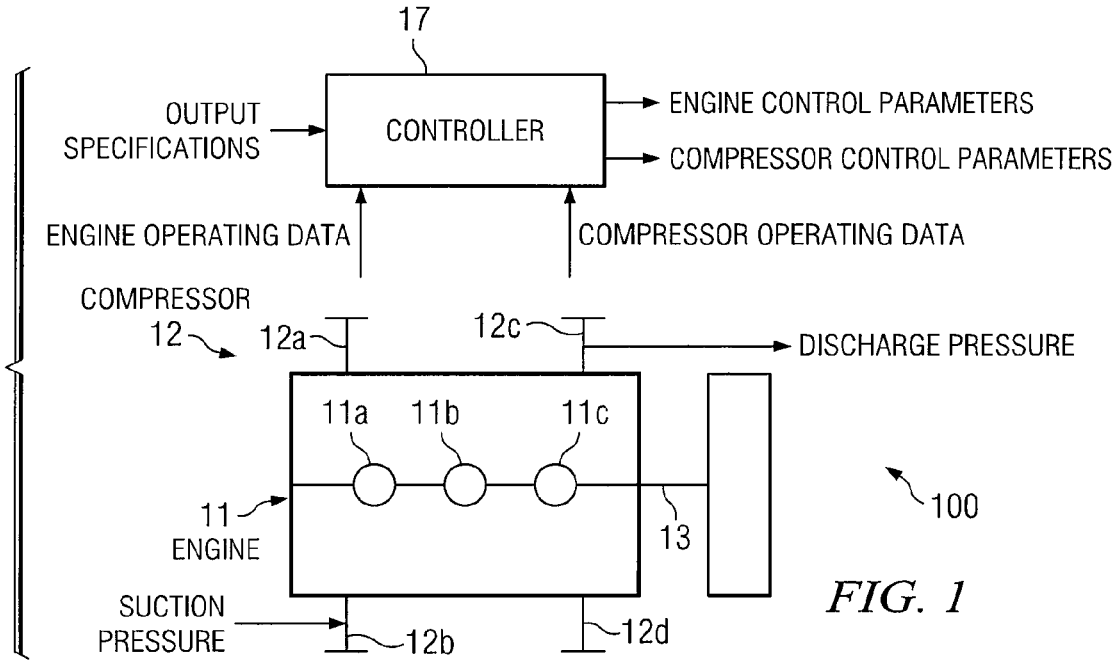
FIG. 1 illustrates an integrated engine/compressor system.

FIG. 1 illustrates a reciprocating gas compressor system 100. Compressor system 100 is an "integrated" compressor system in the sense that its engine 11 and compressor 12 share the same crankshaft 13. The engine 11 is represented by three engine cylinders 11*a*-11*c*. Typically, engine 11 is a two-stroke engine. The compressor 12 is represented by four compressor cylinders 12*a*-12*d*. In practice, engine 11 and compressor 12 may each have fewer or more cylinders.

Figure 2:
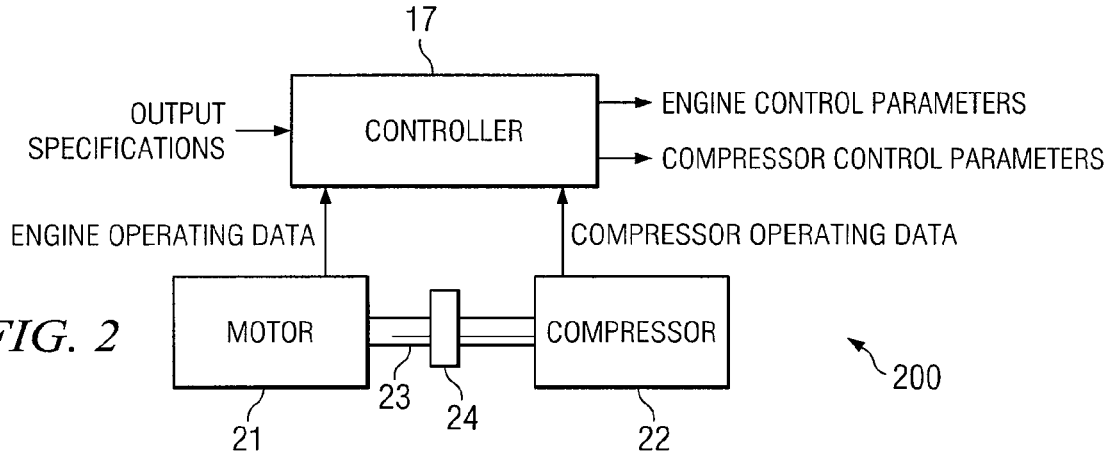
FIG. 2 illustrates a compressor system in which the engine and compressor are separate.

FIG. 2 illustrates a reciprocating gas compressor system 200 in which the engine (or motor) 21 and compressor 22 are separate units. This engine/compressor configuration is referred to in the industry as a "separable" compressor system. The respective crankshafts 23 of engine 21 and compressor 22 are mechanically joined at a gearbox 24, which permits the engine 21 to drive the compressor 22.

As indicated in the Background, a typical application of gas compressor systems 100 and 200 is in the gas transmission industry. System 100 is sometimes referred to as a "low speed" system, whereas system 200 is sometimes referred to as a "high speed" system. The trend in the last decade is toward separable (high speed) systems, which have a smaller footprint and permit coupling to either an engine or electric motor.

Both systems 100 and 200 are characterized by having a reciprocating compressor 12 or 22, which has one or more internal combustion cylinders. Both systems have a controller 17 for control of parameters affecting compressor load and capacity.

Engine 11 (FIG. 1) or motor 21 (FIG. 2) is used as the compressor driver. That is, the engine's or motor's output is unloaded through the compressor. In the example of this description, motor 21 is an electric motor, but the same concepts could apply to other engines or motors.

As shown in FIG. 1, the compressor systems operate between two gas transmission lines. A first line, at a certain pressure, is referred to as the suction line. A second line, at a higher pressure, is referred to as the discharge line. Typically, the suction pressure and discharge pressure are measured in psi (pounds per square inch). In practical application, gas flow is related to the ratio of the suction and discharge pressures.

The following description is written in terms of the separable system 200 (FIG. 2) driven by motor 21. However, the same concepts are applicable to system 100; as indicated in FIGS. 1 and 2, the same controller 17 may be used with either type of system, modified for the particular drive equipment (engine or motor).

Figure 3:
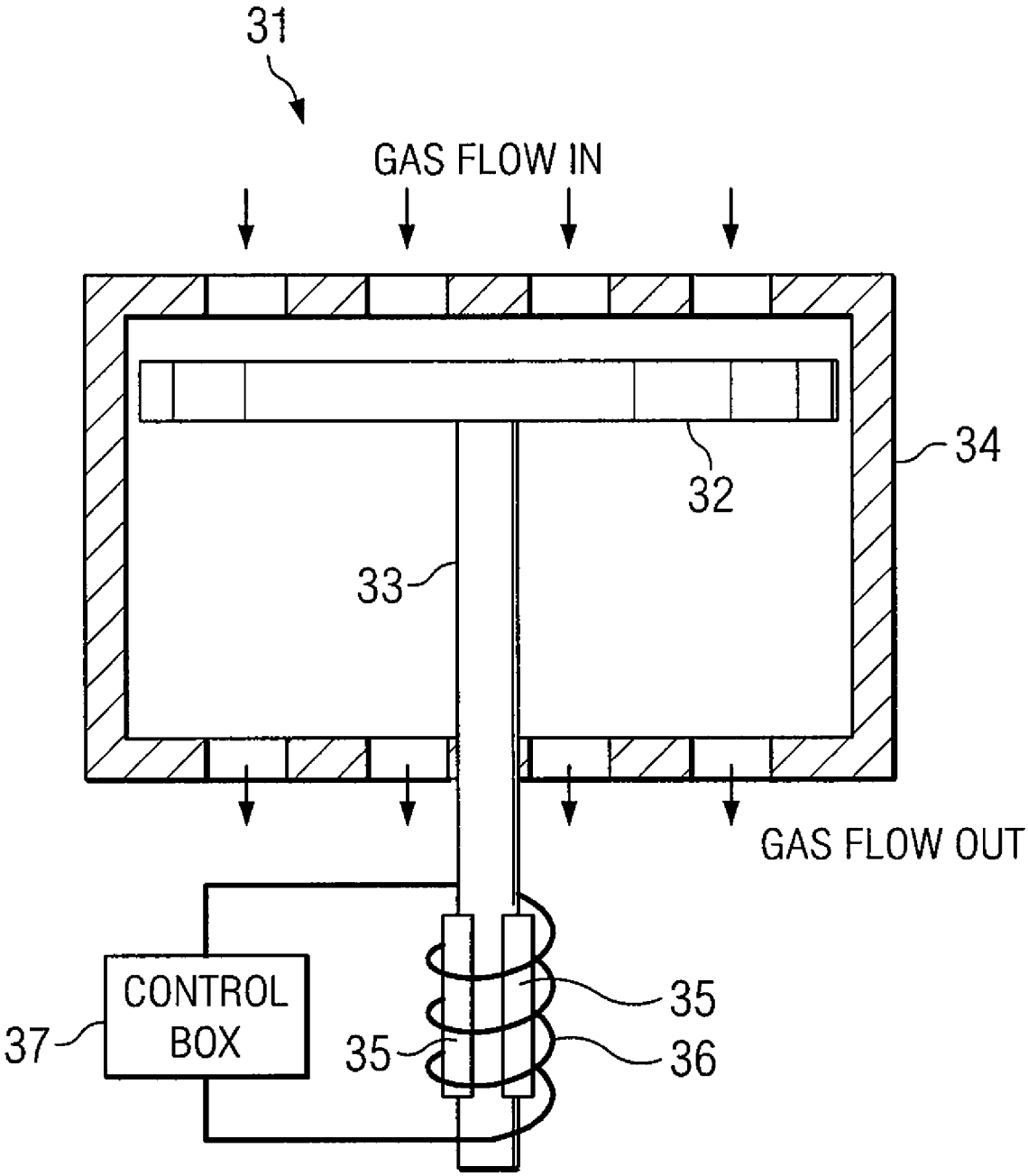
FIG. 3 illustrates a semi-active valve in accordance with the invention, to be used with the compressor cylinders of FIG. 1 or 2.

FIG. 3 is a cross sectional view of a compressor valve 31 in accordance with the invention. Valve 31 is a plate type valve, having a valve plate 32 and valve shaft 33 that move up and down within a valve housing 34.

In other embodiments, valve 31 could be some other type of valve, such as a poppet, check, or ring valve, and the term "plate" is used herein to mean whatever element (i.e., plate, disk, plug, etc.) is used to open or shut off flow. Similarly, the "housing" could be a spring around the shaft or any other rigid structure that guides the motion of the shaft. Some types of valves may have multiple shafts.

The operation of valve 31 is conventional insofar as the valve plate 32 is driven aerodynamically. However, in a conventional valve, the plate is repeatedly driven open and shut against the ends of the valve housing, which causes high pressure forces and a high rate of wear and tear. The velocity at which the plate strikes the end of the cylinder housing is referred to herein as its "impact velocity".

As explained below, this description is directed to using electromagetic forces to slow the velocity of the plate 32 to reduce impact forces. These electromagnetic forces are not the main driving force for the plate 32, but rather are used to fine-tune its velocity.

To this end, the motion of valve plate 32 is secondarily controlled by using electromagnetic forces applied to valve shaft 33, which is attached to plate 32 at its center. Shaft 33 is a "stub" shaft, rigidly connected to the valve plate 32 to move with the plate 32. The attachment means may be such that shaft 33 is removable. Shaft 33 has embedded permanent magnets 35 along its axis. Outside valve housing 34, shaft 33 is surrounded by electrical coils 36.

Movement of plate 32 within housing 34 will result in an induced current in coils 36, which can be directly measured to determine the plate's velocity and location. Also, coil 36 can be activated to affect the movement of shaft 33 and the position of plate 32. For example, if the plate's velocity exceeds a desired impact velocity, the coil 36 can be used to control the position of the plate by inducing an opposing current.

In an alternative embodiment, the location of the coil and magnets relative to shaft 33 may be switched. That is, coil 36 may be placed on shaft 33 and magnets 35 placed outside housing 34. Also, either a single coil can be used for sensing and control (as shown in FIG. 3), or two coils, one for sensing and one for control, may be used. If the valve has more than one shaft, coils (or magnets) may be placed on multiple shafts.

In this manner, the motion of valve plate 32 (both opening and closing) may be sensed by means of magnets 35 and coil 36, which act as an electric inductive motion sensor. If the motion of plate 32 initiates due to a pressure differential across valve 31, the magnets 35 will induce a current into coils 36. This current is sensed by controller 37. If the velocity of the plate exceeds a certain threshold, the same (or an additional) coil/magnet combination can be used to counteract the motion of the plate and slow it down.

In this manner, the valve's motion may be fine-tuned using electromagnetic actuation. Once a small motion is sensed, controller 37 may use a larger counter current to actively control the motion and position of plate 32. The motion sensor and motion control for plate 32 can be integrated into a linear electromagnetic sensing and control device 37.

Control device 37 is typically implemented with software within one or more microprocessors or other controllers. However, implementation with other circuitry is also possible. In general, a reference to a particular process for sensing or controlling the motion of plate 32 represents programming of controller 37 to implement the function. As explained below, controller 37 also has memory so that stored values accessed to determine if the speed of plate 32 exceeds a threshold and to determine how much to slow its motion. Velocity of the plate can be determined by using time and displacement measurements.

The invention described herein permits secondary control of valve plate 32 without the need for internal pressure transducers or shaft encoders. The design uses electromagnets to actively control impact velocities. The plate lift and impact velocity can be finely controlled to improve valve efficiency, capacity, and durability. If the plate control provided by the present invention is not desired or fails, the shaft 33 can be removed and the valve 31 can continue to function as a passive plate valve.

Valve 31 can be used to create a soft landing at both the valve seat on closing and at the valve guard on opening. Valve 31 may be referred to as a "semi-active electromagnetic valve" because it is still activated by gas pressure and only controlled prior to impact. Experimentation has shown that the semi-active valve's plate impact velocities can be reduced by up to 90 percent, increasing plate life by a factor of 15.

What is claimed is:

1. A gas compressor valve, whose primary driving force for opening and closing is aerodynamic gas pressure, comprising:

a valve housing having at least one input port and at least one output port;

a valving element within the housing that moves within the housing to control passage of fluid through the valve in response to the aerodynamic gas pressure;

at least one shaft attached to the valving element;

at least one magnet attached to the shaft;

at least one coil surrounding the shaft, operable to sense both valve opening and valve closing motion after the valve is activated by aerodynamic gas pressure, to slow both the valve opening and valve closing motion; and a controller for receiving a motion sensing signal from at least one coil, for interpreting the motion sensing signal as valve opening and valve closing motion, and for delivering a counteraction signal to at least one coil to slow the valve opening and valve closing motion.

2. The valve of claim 1, wherein the valving element is a plate of a plate valve.

3. The valve of claim 1, wherein the controller is further configured to determine the current velocity of the valve shaft, to compare the current velocity to a predetermined stored threshold value, and to deliver the counteraction signal only if the velocity exceeds the threshold value.

4. A gas compressor valve, whose primary driving force for opening and closing is aerodynamic gas pressure, comprising:

a valve housing having at least one input port and at least one output port a valving element within the housing that moves within the housing to control passage of fluid through the valve in response to aerodynamic gas pressure;

at least one shaft attached to the valving element;

at least one coil attached to the shaft;

at least one magnet proximate the shaft wherein the coil i operable to sense both valve opening and valve closing motion after the valve is activated by the aerodynamic gas pressure, and to slow both the valve opening and valve closing motion; and a controller for receiving a motion sensing signal from at least one coil, for interpreting the motion sensing signal as valve opening or valve closing motion, and for delivering a counteraction signal to at least one coil to slow the valve opening and valve closing motion.

5. The valve of claim 4, wherein the valving element is a plate of a plate valve.

6. The valve of claim 4, wherein the controller is further configured to determine the current velocity of the valve shaft, to compare the current velocity to a predetermined stored threshold value, and to deliver the counteraction signal only if the velocity exceeds the threshold value.

* * * * *